United States Patent [19]

Sedlaczek et al.

[11] 4,257,649

[45] Mar. 24, 1981

[54] COAL COMBINE

[75] Inventors: Janusz Sedlaczek, Gliwice; Marian Krutki, Katowice; Kornel Olender, Gliwice, all of Poland

[73] Assignee: Centralny Osrodek Projektowokonstrukcyjny Maszyn Gorniczych "Komag", Gilwicke, Poland

[21] Appl. No.: 19,641

[22] Filed: Mar. 12, 1979

[30] Foreign Application Priority Data

Mar. 3, 1978 [PL] Poland ..... 205805

[51] Int. Cl.[3] ..... E21C 29/24

[52] U.S. Cl. ..... 299/43; 105/29 R

[58] Field of Search ..... 299/42, 43, 34; 74/422; 105/29 R

[56] References Cited

U.S. PATENT DOCUMENTS

| | | | |
|---|---|---|---|
| 3,399,578 | 9/1968 | Lindsbury, Sr. et al. | 74/422 X |
| 4,006,786 | 2/1977 | Curtis | 299/43 |
| 4,099,786 | 7/1978 | Nakajima | 299/43 |
| 4,103,975 | 8/1978 | Funke et al. | 105/29 R |

*Primary Examiner*—William F. Pate, III
*Attorney, Agent, or Firm*—Haseltine and Lake

[57] ABSTRACT

The invention solves the problem of eliminating the transfer of the combine weight onto a conveyor through a chain instead of through a railing, in the combines which are advanced by means of a link chain meshing with a rack fixed alongside of the conveyor.

To this end the slide skid (7) forcing the chain (1) to mesh with the rack (8) is provided with a tubular slipper (10). The tubular slipper (10) encloses a railing (11) situated in the gates of the conveyor (9) close to the rack (8). The tubular slipper (10) is mounted on a cranked axle (12). The cranked axle (12) has - on the end of the pin embedded in the slide skid (7) - a splined tip (16) embedded in a grooved hole (17) which has a common geometrical axis (15) with the pin of the cranked axle (12), the said pin being embedded in the slide skid (7). The tubular slipper (10) mounted on the pin (14) of the cranked axle (12) is protected against slipping off into the tubular slipper (10).

1 Claim, 2 Drawing Figures

COAL COMBINE

FIELD OF THE INVENTION

The invention relates to a coal combine advancing on a conveyor and provided with a device for driving the combine along the conveyor, said device consisting of an endless link chain reqound by a drive chain wheel and a reversible wheel, said chain meshing—in its straight section—with a chain rack fixed alongside of the conveyor.

PRIOR ART

The coal combine advancing on a longwall conveyor and driven by the device including an endless link chain is known from the Polish patent application No. P.1777758. The device is mounted into the combine and consists of a drive chain wheel, a reversible wheel, and directing wheels. The wheels are fixed to the combine. On the aforesaid wheels the endless link chain is wound, one section of which is situated parallel to the conveyor and is supported in such position by a deflecting block, i.e. by a slide skid. The section of the chain, supported by the deflecting block, meshes with a rack situated alongside of the conveyor, on one of the shelves of the conveyor, the teeth of the rack having a shape fitted for co-operation with the link chain. The reversible drive wheels and the directing wheels are toothed as well, their teeth being fitted for co-operation with the link chain. While rotating, the drive wheel driven by the motor of the combine makes the link chain rewind over the reversible wheel and the directing wheels, and the section of the chain which co-operates with the rack fixed alongside of the conveyor, makes the combine advance along the conveyor, similarly as it is in crawlers. To the conveyor, along its whole length, a railing of circular section is fixed. To the flat surface of the combine a tubular slipper is fixed with screws, said slipper being provided with a circular recess from the side of the conveyor in order to enclose the railing. The combine advancing on the conveyor is protected against falling off the conveyor due to the slipper enclosing at least half of the perimeter of the railing. In the section in which the link chain meshes with the rack, the chain in guided from above by the deflecting block, i.e. by the slide skid whose surface is parallel to the rack.

A disadvantage of the known device is that during operation the inter-tooth spaces of the rack are filled with fine coal, and consequently the chain is raised, meeting the slide skin from above. At a certain state of the inter-tooth spaces being filled with fine coal, the weight of the combine—instead of being transferred onto the railing—is transferred onto the rack by means of the chain. Then the vertical links of the chain, loaded with the weight of the combine through the slide skid, are pressed down to the rack and, consequently, are deformed and abraded on their surfaces which contact the slide skid. In the result of this, the chain is worn, and especially its links undergo decalibration which impedes meshing of the chain with the drive wheel and the reversible wheel, and, in consequence, disturbs the fluency of co-operation between the link chain and all elements with which it meshes. Despite the fact that the driving device is provided with scrapers cleaning the rack, nevertheless, they are not very effective and do not protect the rack against fouling.

SUMMARY OF THE INVENTION

A object of the invention is to provide a combine in which transfer of the combine weight onto the conveyor through the chain instead of through the railing is eliminated.

This object has been achieved by mounting the tubular slipper on a cranked axle which, when turned, makes the slipper change its position in relation to the combine, and consequently, the slipper either approaches the rack on the conveyor or recedes from it. Additionally, the cranked axle has, on the end of the pin embedded in the combine, a splined tip embedded in a grooved hole made in the combine coaxially with the hole in which the pin of the cranked axle is embedded in the combine. The splined tip of the axle embedded in the grooved hole protects the cranked axle against turning in the hole of the combine, under the effect of the combine weight.

BRIEF DESCRIPTION OF THE DRAWINGS

The subject of the invention in the realization example is illustrated in the drawing in which.

DETAILED DESCRIPTION

Figure 1:
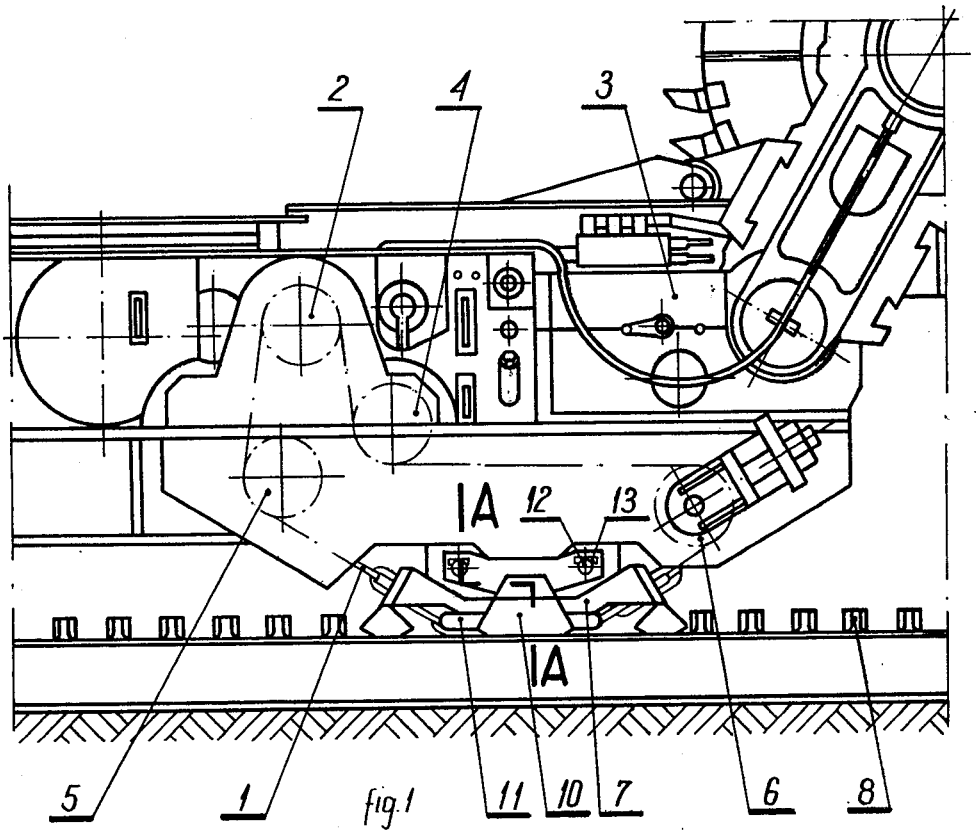
FIG. 1 is a side view of a fragment of the combine showing the driving device of the combine.
Figure 2:
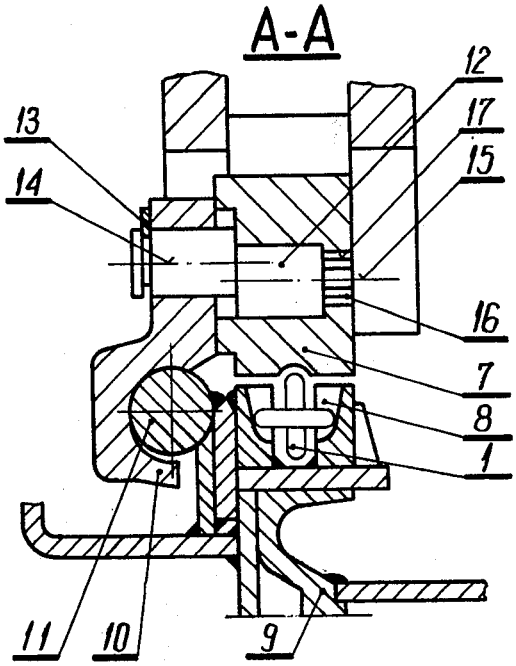
FIG. 2 is a part of a cross section of the combine showing the tubular slipper and the cranked axle.

In the body 3 of the combine a drive wheel 2 and a reversible wheel 6 are mounted. Between them a link chain 1 runs whose direction is controlled by directing wheels 4 and 5. In a certain section the link chain 1 slides over a slide skid 7 situated parallel to the rack 8. The skid 7 makes the chain 1 mesh with the rack 8. The slide skid 7 is provided with a tubular slipper 10. The tubular slipper 10 encloses a railing 11 situated in the gates of a conveyor 9 close to the rack 8. The tubular slipper 10 is mounted on a cranked axle 12. The cranked axle 12 has, on the end of the pin embedded in the slide skid 7, a splined tip 16 embedded in a grooved hole 17 which has a common geometrical axis 15 with the pin of the cranked axle 12 embedded in the slide skid 7. The tubular slipper 10 mounted on a pin 14 of the cranked axle 12 is protected against sliding down of the pin 14 by means of an insert 13 introduced into a groove made at the end of the pin 14. The insert 13 is fixed to the tubular slipper 10. The body 3 of the combine, displaced along the conveyor, is supported by means of the tubular slipper 10 upon the railing 11. Due to this a part of the combine weight is transferred onto the railing 11, and then onto the conveyor. A link chain 1 meshes with the rack 8, and the chain links which are perpendicular to the rack fit in the inter-tooth spaces and from above they slide over the slide skid 7. When the combine is in operation, the inter-tooth spaces of the rack 8 are filled with fine coal, which causes that vertical links of the chain 1 are raised. Consequently, the body 3 of the combine rests with the slide skid 7, through the links of the link chain 1 by means of fine coal, on the conveyor. Then the combine is raised and the tubular slipper 10 looses contact with the railing 11. In such situation, part of the combine weight which has been previously transferred onto the railing 11 begins to be transferred through the links of the chain 1. Since the links are not designed for transferring such large shearing forces, they are squeezed and abraded. After a certain time of use, the vertical links are deformed and the chain loses its regular link pitch, which disturbs the cooperation between the link chain 1 and the rack 8, as well as the wheels 2, 4, 5, 6. The advance of the combine along the conveyor becomes irregular, the chain is damaged—and especially its quick-coupling links and the wheels 2, 4, 5, 6—and the operation of the mining units assumes a striking character which causes faster wear of mining cutters. When the situation described above occurs, it is necessary to correct the position of the tubular slipper 10. In order to do this, the insert 13 is removed, the tubular slipper 10 is dismounted from the pins 14 of the cranked axle 12 from the grooved hole and is turned so as the pin 14 is in a slightly lower position than before, i.e. it approaches the railing 11. The cranked axle 12 is then pushed again with its splined tip 16 into the grooved hole 17 in the slide skid 7. Then the tubular slipper 10 is attached onto the pins 14 and secured with the insert 13. Due to this, the tubular slipper 10 recovers contact with the railing 11. Between the surface of the slide skid 7 and the teeth of the rack 8 more space is created, and due to this the vertical links of the link chain 1, despite the fact that they have been raised by fine coal deposited in the rack 8, do not transfer the weight of the combine.

What is claimed is:

1. An improved coal combine advancing on a conveyor, provided with a device driving the combine along the said conveyor, employing an endless link chain rewound by means of a drive wheel and a reversible wheel, said chain meshing in its straight section, with a chain rack fixed alongside of the conveyor, said combine being disposed at the side of the driving device on the conveyor, by means of a railing forming a part of the conveyor being further situated along the whole length of the conveyor, and the combine resting on said railing by means of a tubular slipper fixed to the combine, the improvement comprising; cranked axles (12) fixing the tubular slipper (10) to the body (3), said axles (12) being mounted in the body (3) of the combine, the body (3) of the combine having a grooved hole (17) whose axis (15) is in line with the geometrical axis of the cranked axle (12) and an extension of the said cranked axle (12) being provided with a splined tip embedded in the hole (17).

* * * * *